US008495832B2

(12) United States Patent
Vukovic

(10) Patent No.: US 8,495,832 B2
(45) Date of Patent: Jul. 30, 2013

(54) MAGAZINE DEPENDENT SAFETY MECHANISM OF A HANDGUN

(75) Inventor: Marko Vukovic, Karlovac (HR)

(73) Assignee: HS Produkt D.O.O., Karlovac (HR)

( * ) Notice: Subject to any disclaimer, the term of this patent is extended or adjusted under 35 U.S.C. 154(b) by 364 days.

(21) Appl. No.: 13/003,892

(22) PCT Filed: Jul. 22, 2009

(86) PCT No.: PCT/HR2009/000026
§ 371 (c)(1),
(2), (4) Date: Jan. 13, 2011

(87) PCT Pub. No.: WO2010/010410
PCT Pub. Date: Jan. 28, 2010

(65) Prior Publication Data

US 2011/0126441 A1 Jun. 2, 2011

(30) Foreign Application Priority Data

Jul. 25, 2008 (HR) ..... P 20080372 A
Aug. 21, 2008 (HR) ..... P 20080409 A

(51) Int. Cl.
*F41A 17/00* (2006.01)

(52) U.S. Cl.
USPC ..... 42/70.02; 42/70.04; 42/70.05; 89/144; 89/150

(58) Field of Classification Search
USPC ..... 42/70.02, 70.04, 70.05; 89/150, 89/144, 142
See application file for complete search history.

(56) References Cited

U.S. PATENT DOCUMENTS

| | | | | |
|---|---|---|---|---|
| 4,031,648 | A | 6/1977 | Thomas | |
| 5,438,784 | A * | 8/1995 | Lenkarski et al. | 42/70.02 |
| 6,457,271 | B1 * | 10/2002 | Vaid et al. | 42/70.02 |
| 6,789,342 | B2 * | 9/2004 | Wonisch et al. | 42/75.02 |
| 7,096,618 | B2 * | 8/2006 | McGarry | 42/70.02 |
| 7,140,141 | B2 | 11/2006 | Vaid | |
| 7,392,611 | B2 | 7/2008 | Curry | |
| 8,371,058 | B2 * | 2/2013 | Trpcic | 42/108 |

FOREIGN PATENT DOCUMENTS

DE 100 52 468 A1 5/2002

OTHER PUBLICATIONS

USPTO Office Action issued for U.S. Appl. No. 12/997,015 mailed Aug. 17, 2012.
Ezell et al., "Small Arms of the World—A Basic Manual of Small Arms," Jan. 1, 1983, Part I, Chapter 4 "Handgun Developments" pp. 136-152.
International Search Report and Written Opinion for PCT International Application No. PCT/HR2009/000026 mailed Nov. 26, 2009.

* cited by examiner

*Primary Examiner* — J. Woodow Eldred
(74) *Attorney, Agent, or Firm* — RatnerPrestia

(57) ABSTRACT

The invention discloses a safety mechanism of a handgun which depends on a magazine and which prevents the triggering of a handgun when the magazine is removed. Additionally, a mechanism enables handgun disassembly without need for the triggering after the magazine has been removed from the handgun. A safety mechanism is positioned inside the handgun receiver; including a magazine, sear catcher, sear catcher spring, grip safety pin, sear, sear pin, firing pin safety lever and firing pin. When the magazine is inserted into the handgun, the sear catcher is pushed into position in which it cannot block the firing pin safety lever nor catch the sear. When the magazine is removed from the handgun, the sear catcher spring pushes the sear catcher into position in which it blocks the firing chain by blocking the firing pin safety lever. At the same time it brings the sear catcher into position where it can hold the sear below the plane of the cocking of the firing pin as soon as the sear is sufficiently rotated around the sear pin by retracting the slide.

5 Claims, 5 Drawing Sheets

MAGAZINE DEPENDENT SAFETY MECHANISM OF A HANDGUN

CROSS REFERENCE TO RELATED APPLICATIONS

This application is the U.S. National Phase Application of PCT/HR2009/000026, filed Jul. 22, 2009, which claims priority to Croatian Patent Application Nos. P20080372A, filed Jul. 25, 2008 and P20080409A, filed Aug. 21, 2008, the contents of such applications being incorporated by reference herein.

FIELD OF THE INVENTION

The subject invention refers to the handgun safety mechanism that is magazine dependent. The subject invention belongs to the field of inventions which prevent the triggering of a handgun when the magazine is not inserted into a handgun, and which, in addition, allow for the disassembly of a handgun without triggering when the magazine is removed.

TECHNICAL PROBLEM

The first technical problem this subject invention solves is preventing the triggering of a handgun when the magazine is removed. Namely, it is known and often happens in practice that a gun operator assumes that the handgun is not loaded once operator removes the magazine, but a round can remain in the barrel and it can cause accidental firing.

Another technical problem that is at the same time solved by this subject invention is the construction of the mechanism of a handgun that allows for the handgun to be disassembled without triggering as soon as the magazine is removed. It is known that the disassembly of a handgun with a cocked firing pin leads to the triggering of the handgun in the process of disassembly. Every such triggering poses a risk of an accidental firing of the round that remained in the barrel upon triggering which is a necessary part of the disassembly, and which is completely avoided by this subject invention.

STATE OF ART

In the patent literature we find a significant number of technical solutions regarding the first technical problem—the prevention of the triggering of a handgun with a removed magazine. The solution provided by U.S. Pat. No. 4,031,648 (Frank S. Thomas) from 1975 solves the above mentioned basic technical problem. The given technical solution solves the primary technical problem in a different way, but it does not solve the second technical problem—the problem of disassembly without triggering.

Regarding the second technical problem—the disassembly of a handgun without triggering—the closest technical solution is found in the international patent PCT/HR2009/000023 (HS PRODUKT d.o.o.). The said technical solution solves only the second technical problem—the disassembly of a handgun without triggering—but it does not solve the first technical problem—the prevention of the triggering of a handgun with a removed magazine.

THE SUMMARY OF THE INVENTION

The subject invention prevents the triggering of the handgun once the magazine has been removed, and also enables the disassembly of the handgun without the need for subsequent triggering after the removal of the magazine. This safety mechanism is positioned inside the receiver and it consists of: the magazine, sear catcher, sear catcher spring, grip safety pin, the sear, sear pin, firing pin safety lever and the firing pin. According to the invention, this mechanism enables the following:

- when the magazine is inserted, the sear catcher is pushed into position in which it cannot block the firing pin safety lever nor can it catch the sear; and
- when the magazine is removed from the handgun, the sear catcher spring pushes the sear catcher into position in which it blocks the firing chain by blocking the firing pin safety lever; at the same time, the sear catcher is brought into position in which it can hold the sear beneath the plane of the cocking of the firing pin as soon as the sear is sufficiently rotated around the sear pin by retracting the slide.

BRIEF DESCRIPTION OF THE FIGURES

FIG. 1 shows spatial layout of the mechanism.

FIG. 2 shows the layout of the handgun elements as seen by the operator prior to the disassembly, when the magazine is inserted.

FIG. 3 shows the situation when the magazine is inserted.

FIG. 4 shows the same situation as FIG. 3, only with more detail and with a clearer spatial layout of the elements of the invention.

FIG. 5 shows the spatial layout of the elements of a handgun as seen by the operator when the magazine is removed, while FIG. 6 shows the situation when magazine is removed in relation to the corresponding situation shown on FIG. 3 when the magazine is inserted.

FIG. 8 shows the layout of the elements of a handgun as seen by the operator after the magazine has been removed, the disassembler rotated and the slide pulled backwards.

FIG. 9 shows the position of the mechanism according to the subject invention, FIG. 10 shows the same situation as on FIG. 9, only with a clearer spatial layout.

FIG. 11 shows the position of the slide and the layout of elements before the slide is removed from the receiver.

FIGS. 12 and 13, show the interrelated positions of functional parts and show why the firing pin does not get cocked during the disassembly.

A DETAILED DESCRIPTION OF THE INVENTION

It was mentioned earlier that the basic technical problem that the subject invention solves is preventing the triggering of a handgun when the magazine is removed. Unfortunately, the practice of firearm usage is full of accidents related to accidental firings caused by the operator's carelessness or ignorance. According to the subject invention, triggering is immediately prevented when the magazine is removed from the handgun because the firing chain is blocked. Technical solution according to the subject invention also allows disassembly of a handgun without triggering as soon as the magazine is removed.

Figure 1:
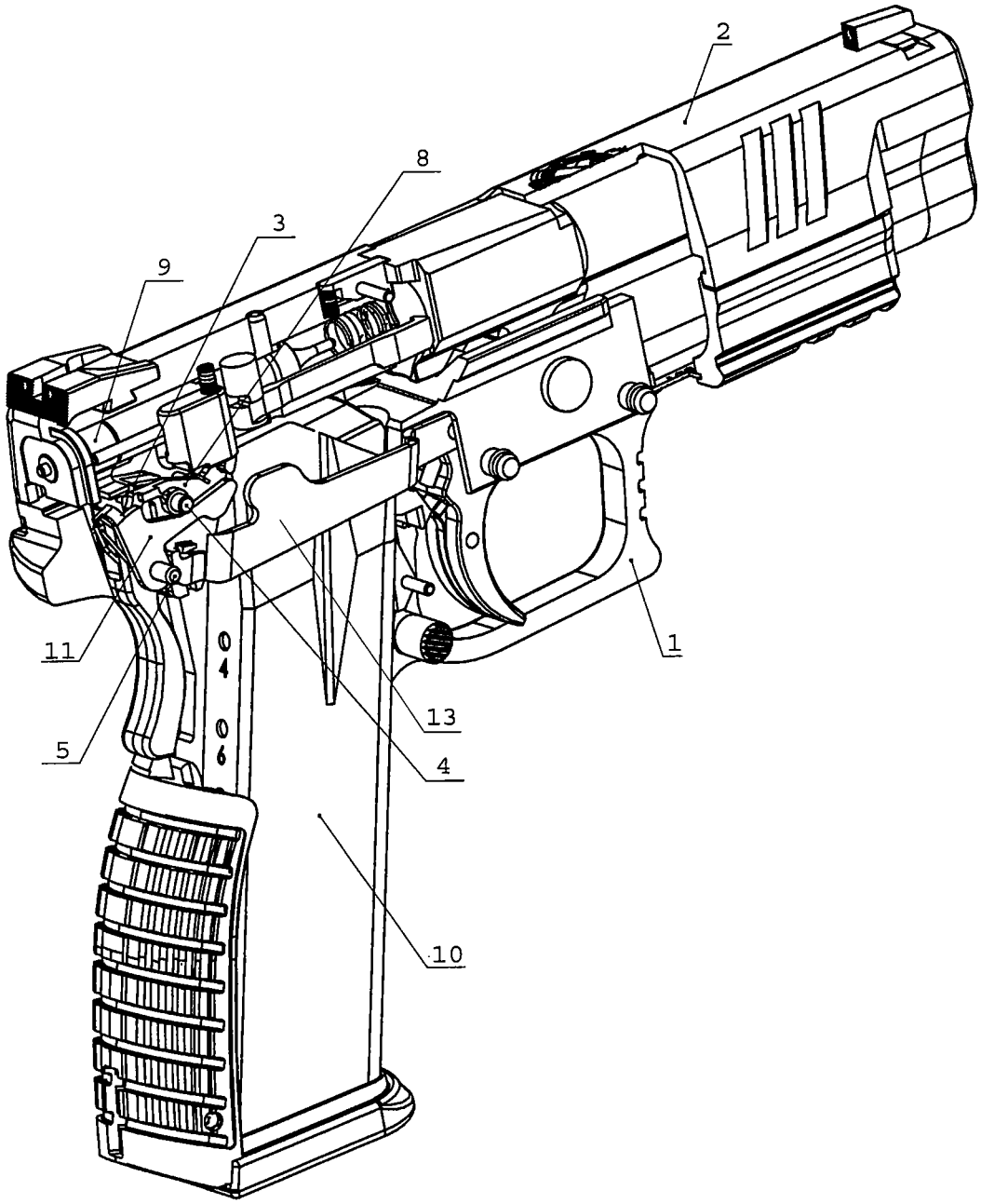
In FIGS. 1-13 one possible embodiment of the subject invention is shown.

The layout of the handgun elements is shown in FIG. 1; the slide (2) is positioned on the receiver (1), while the mechanism itself consists of the sear (3), sear pin (4), grip safety pin (5), the firing pin (9), the magazine (10), sear catcher (11) and the activating lever (13) of the triggering mechanism.

Figure 2:
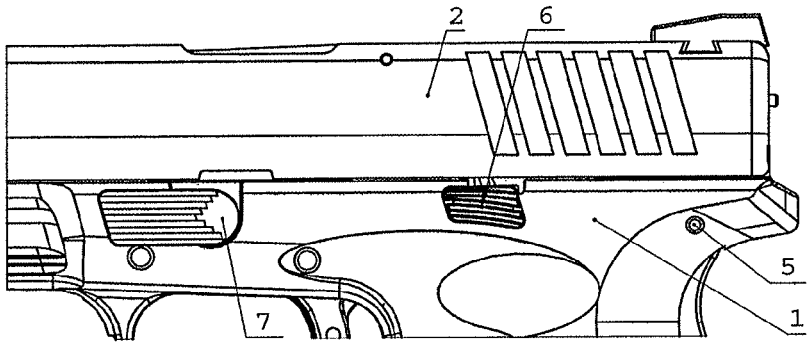
Figure 3:
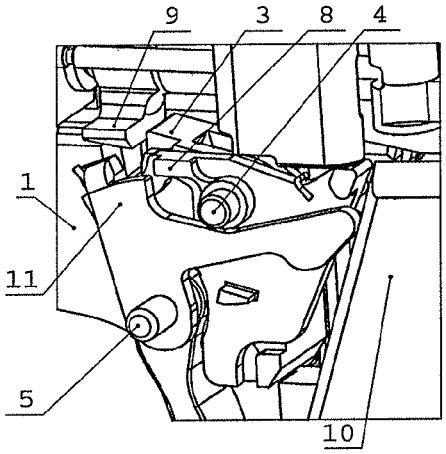

FIG. 2 shows the situation before the beginning of a disassembly of a handgun; the disassembler (7) is not activated, slide stop lever (6) is not in a position where it detains the slide (2), the magazine (10) is inserted into a handgun. The mechanism according to the subject invention is conceived in such a way that the sear catcher (11) can move in rotation around the grip safety pin (5) in a way that it is constantly pushed towards the magazine (10) by a sear catcher spring (12). FIG. 3 shows how the body of a magazine (10) holds the sear catcher (11) which leans on the magazine (10) and leaves the sear catcher (11) in a position which:

does not enable the catching and the holding of the sear (3), and does not block the firing pin safety lever (8).

Figure 5:
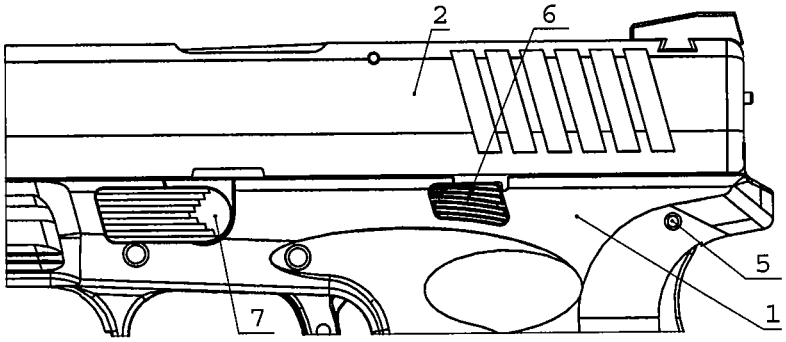

FIG. 5 shows a situation which is, from the operator's perspective, different from FIG. 2 only in that the magazine (10) is removed from a handgun—the magazine cannot be seen because it is positioned inside the receiver (1). It is visible from FIG. 6 that the sear catcher spring (12) now pushes and rotates the sear catcher (11) around the grip safety pin (5) (in the direction of the arrow in FIG. 6) in a way that:

the sear catcher (11) abuts the sear (3) but it does not perform the catching of the sear (3), i.e. the firing pin (9) is still beneath the plane of the sear (3) and it latches onto it—FIG. 7; and the sear catcher (11) partly slides under the firing pin safety lever (8) and blocks its moving around the sear pin (4).

According to the invention, the firing chain is thus blocked; the activation lever (13) can no longer move the firing pin safety lever (8) which is blocked by the sear catcher (11) prong, which solves the first technical problem of the invention—prevention of the triggering of the handgun when the magazine is removed.

Figure 8:
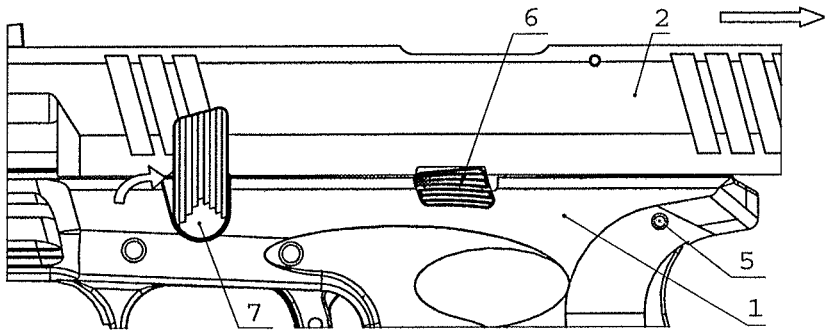
Figure 9:
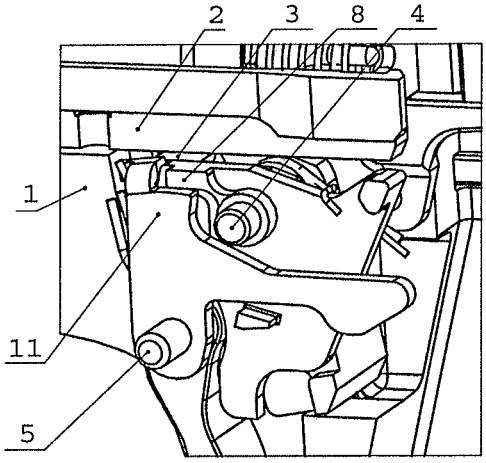
Figure 10:
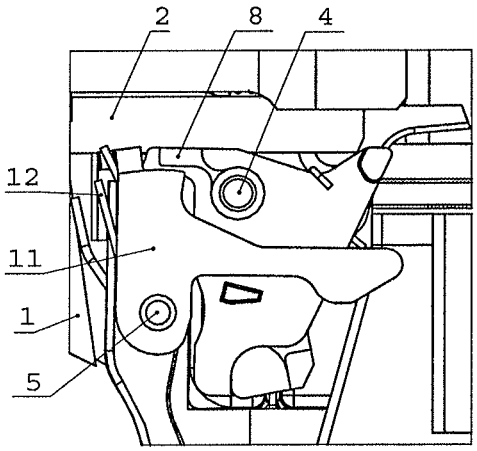

In order to continue with the disassembly, it is necessary to move the disassembler (7) as shown in FIG. 8 and pull the slide (2) backwards (in the direction of the arrow) until the slide is detained on the slide stop lever (6). Prior to pulling the slide (2) backwards—the magazine (10) was removed at the previous stage, and the sear catcher (11) abuts the sear (3). The retracting of the slide (2) rotates the sear (3) counterclockwise around the sear pin (4) which bring the sear (3) into position to be caught by the sear catcher (11). In the moment when the sear (3) is sufficiently pushed, the sear catcher (11) which is pushed by the spring (12) catches and holds the sear (3) with its prong—the sear is held in that position, while at the same time the sear catcher prong slides more deeply under the firing pin safety lever (8)—FIGS. 9 and 10. The firing pin (9) can no longer get cocked on the sear (3) when the sear (3) is caught in that position (FIG. 10) by the sear catcher (11).

Figure 11:
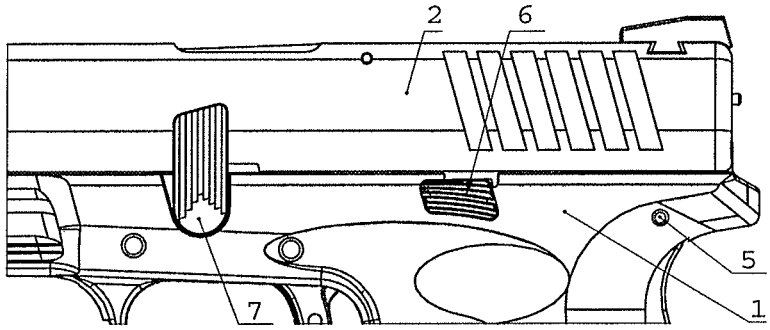
Figure 12:
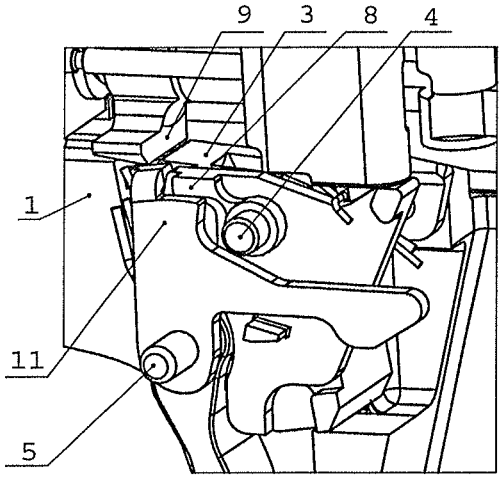
Figure 13:
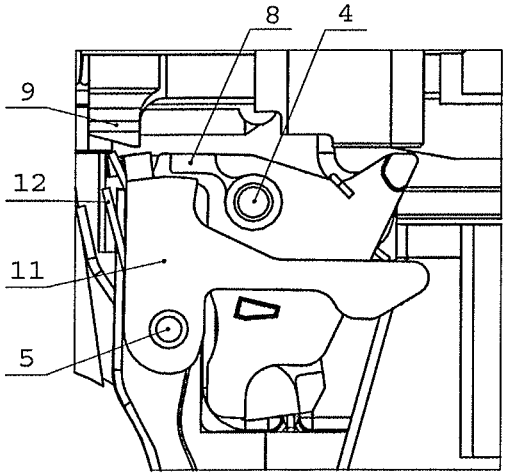

Now it is possible to push the slide (2) into position shown in FIG. 11 and remove it from the receiver (1) by moving it forwards. The sear (3) is blocked beneath the plane of cocking of the firing pin (9), and the firing pin safety lever (8) is entirely blocked by the moving of the sear catcher (11) which is pushed by the spring (12)—FIGS. 12 and 13. Thus the disassembly of a handgun is performed without triggering since there was no cocking of the firing pin (9).

This solves the second technical problem—constructing the mechanism of a handgun that would allow for the handgun to be disassembled without triggering as soon as the magazine is removed.

The assembly of a handgun is performed by the reverse procedure.

It is clear from the figures and descriptions that the releasing of the sear (3) and the firing pin safety lever (8) can only happen at the moment when the slide (2) is in its default position and the magazine (10) is inserted. Only when the magazine (10) is inserted will the sear catcher (11) be pushed into position shown in FIG. 3 and the normal functioning of the handgun will be enabled, i.e. the firing chain will be unblocked by releasing the firing pin safety lever (8).

INDUSTRIAL APPLICABILITY

It is easy to incorporate this magazine-dependant safety mechanism into a handgun. Its feature is that through a small number of additional parts it achieves the desired technical function—preventing the triggering when the magazine is removed and the disassembly without triggering. Therefore, invention applicability as such is unquestionable and it contributes to the safety of handling the said gun at the stage of maintaining/cleaning a handgun and changing a magazine.

REFERENCES (1) receiver
(2) slide
(3) sear
(4) sear pin
(5) grip safety pin
(6) slide stop lever
(7) disassembler
(8) firing pin safety lever
(9) firing pin
(10) magazine
(11) sear catcher
(12) sear catcher spring
(13) activation lever

The invention claimed is:

1. A handgun safety mechanism dependent on a magazine that prevents triggering of a handgun when the magazine is removed and enables disassembly of the handgun without need for decocking of a firing pin after the magazine is removed; a safety mechanism is positioned inside the a receiver of the handgun and comprising:

a slide detachably coupled to the receiver;

the magazine detachably coupled to the receiver, a grip safety pin coupled to the receiver, a sear catcher coupled to the receiver and rotatable about the grip safety pin, a sear catcher spring disposed against a portion of the sear catcher for urging the sear catcher toward the magazine, a sear, a firing pin safety lever, a sear pin coupled to the firing pin safety lever, and a firing pin coupled to the receiver, wherein:

when the magazine is inserted, the sear catcher is pushed by the magazine into a position where the sear catcher cannot block the firing pin safety lever nor catch the sear; and when the magazine is removed from the handgun, the sear catcher is pushed by the sear catcher spring into a position such that the sear catcher blocks a firing chain of the handgun by blocking the firing pin safety lever, and at the same time the sear is caught by the sear catcher when the sear is pressed downwards upon retracting the slide.

2. A handgun safety mechanism dependent on a magazine according to claim 1, which enables the handgun with a removed magazine to be disassembled without need for decocking of the firing pin by retracting the slide onto the slide stop lever; wherein retracting the slide pushes the sear around the sear pin beneath a plane of the cocking of the firing pin, the sear catcher spring additionally pushes the sear catcher which catches the sear and holds it below the plane of the firing pin that prevents cocking of the firing pin during the activation of the dissassembler and removing the slide from the receiver by moving it forward.

3. A method for disassembly of a handgun by a user without triggering the handgun, the handgun being equipped with a handgun safety mechanism dependent on a magazine, the method comprising:

A. removing a magazine from the handgun, which rotates a sear catcher coupled to the handgun to block a firing pin safety lever and thus interrupts a firing chain of the handgun;

B. retracting a slide of the handgun onto a slide stop lever which enables the sear catcher to hold a sear beneath a plane of a cocking of a firing pin, C. rotating, by the user, a lever to enable movement of the slide in a forward direction, and D. removing the slide, from the receiver by moving it forward.

4. A method for reversing the disassembly of the handgun according to claim 3 wherein insertion of the magazine into the handgun pushes the sear catcher to release the sear so that the sear can again reach the plane of cocking of the firing pin, and the sear catcher unblocks the firing pin safety lever.

5. A method for assembly of a handgun by using the handgun safety mechanism dependent on a magazine the method comprising:

A. attaching a slide of the handgun to a receiver of the handgun by moving it rearward;

B. rotating a lever coupled to a receiver of the handgun to enable movement of the slide in a forward direction;

C. moving the slide forward and past a slide stop lever disposed on the receiver; and D. inserting a magazine into handgun, which rotates a sear catcher coupled to the handgun to release the sear so that the sear can reach a plane of cocking of a firing pin, and the sear catcher unblocks a firing pin safety lever to unblock the firing pin and thus enable a firing chain of the handgun.

* * * * *

UNITED STATES PATENT AND TRADEMARK OFFICE

CERTIFICATE OF CORRECTION

Figure 6A:
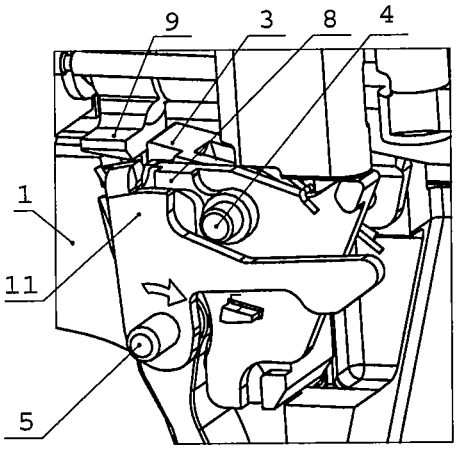
Figure 7A:
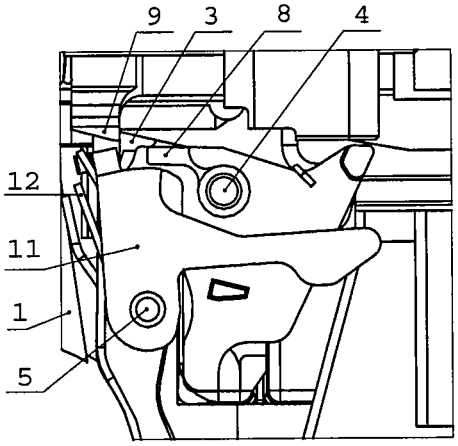

PATENT NO. : 8,495,832 B2
APPLICATION NO. : 13/003892
DATED : July 30, 2013
INVENTOR(S) : Marko Vukovic It is certified that error appears in the above-identified patent and that said Letters Patent is hereby corrected as shown below:

In the Drawings:

Page 3, "Fig. 6A" should read -- Fig. 6 -- and "Fig. 7A" should read -- Fig. 7 --.

In the Specification:

Column 2, line 33 "while FIG. 6 shows" should read -- while FIGS. 6 and 7 show --.

Figure 4:
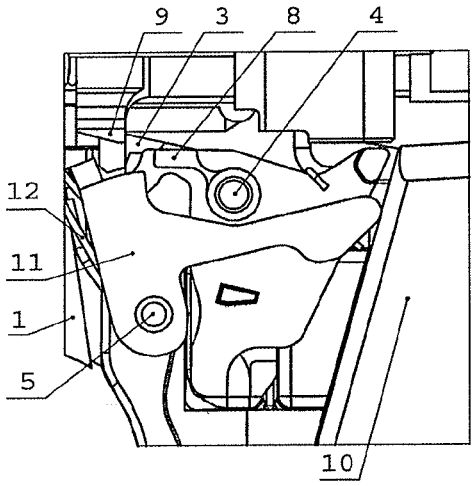

Column 2, line 34 "on FIG. 3" should read -- on FIGS. 3 and 4 --.

Signed and Sealed this
Tenth Day of September, 2013

Teresa Stanek Rea
*Acting Director of the United States Patent and Trademark Office*